US005786578A

United States Patent [19]

Christy et al.

[11] Patent Number: 5,786,578

[45] Date of Patent: Jul. 28, 1998

[54] MICROWAVE-HEATABLE EXERCISE PUTTY IN A CONTAINER WITH TEMPERATURE INDICATOR

[76] Inventors: George M. Christy, 2108 Raven Rd., Pleasanton, Calif. 94566; Robert Parker, 60617 Golf Village Loop, Bend, Oreg. 97702

[21] Appl. No.: 885,502

[22] Filed: Jun. 30, 1997

[51] Int. Cl.[6] ..... H05B 6/80

[52] U.S. Cl. ..... 219/720; 219/710; 219/762; 116/216; 374/150; 374/161; 523/137; 607/78; 607/102

[58] Field of Search ..... 219/720, 710, 219/759, 762; 523/137; 607/78, 101, 102; 116/216, 219; 374/141, 150, 161, 162

[56] References Cited

U.S. PATENT DOCUMENTS

| | | | |
|---|---|---|---|
| 4,786,773 | 11/1988 | Keefer | 219/720 |
| 4,933,525 | 6/1990 | St. Phillips | 219/720 |
| 5,319,021 | 6/1994 | Christy | 524/857 |
| 5,369,257 | 11/1994 | Gibbon | 219/759 |
| 5,446,075 | 8/1995 | Gibbon | 523/137 |
| 5,464,968 | 11/1995 | Germain et al. | 219/710 |
| 5,472,994 | 12/1995 | Micallef et al. | 523/137 |

*Primary Examiner*—Philip H. Leung
*Attorney, Agent, or Firm*—Philip D. Junkins

[57] ABSTRACT

A microwave-heatable therapeutic exercise putty mass is packaged in a microwaveable container having at least one transparent wall. The putty mass within the container is in heat transfer proximity with transparent wall of the container. A thermochromic heat sensitive semiconductor material (strip, label or coating) is affixed to the transparent wall in intimate heat transfer contact with the putty mass. The thermochromatic material provides a visual first indication through the transparent wall when the putty mass has been microwave heated to a heat exercise therapy acceptable temperature range of about 40 to about 47 degrees C. and a visual second indication through the transparent wall when the putty mass has been microwave heated to a temperature range of about 54 to about 60 degrees C. or above which is non-acceptable for heat exercise therapy.

9 Claims, 1 Drawing Sheet

MICROWAVE-HEATABLE EXERCISE PUTTY IN A CONTAINER WITH TEMPERATURE INDICATOR

FIELD OF THE INVENTION

The present invention relates in general to physical therapy putties and more particularly to exercise putty compositions which may be heated in a microwave oven.

BACKGROUND OF THE INVENTION

A group of polysiloxane-boron compounds displaying bounce elasticity have been widely known in commercial markets and product forms. These types of compounds are often referred to as bouncing putties. The viscosity of such materials range from very high to very low. Medium viscosity forms of polysiloxane compounds, displaying bounce elasticity, are marketed as toys under the trademarks "Silly Putty" and "Wacky Putty". These materials can be easily molded or shaped and, unlike the more common molding clays and molding doughs, these polysiloxane-boron materials do not dry out and become hard and brittle over time. Thus, they retain their plasticity, moldability and flexibility for indefinite periods of time.

The use of low to medium viscosity forms of polysiloxane-boron compounds is well known in the physical therapy field. In physical therapy applications these compounds are used in a dough-like form as a medium for muscle exercise. Thus, the material is pulled, stretched and kneaded to aid in the rehabilitation of the hand and arm muscles of a rehab patient. The use of such materials for therapy applications has been disclosed in U.S. Pat. No. 2,541,851, granted to Wright, and in U.S. Pat. No. 3,677,997, granted to Kaiser et al with such polysiloxane-boron putties described as having the property of high bounce elasticity under suddenly applied compression stress and a high degree of plasticity when such stress is applied slowly. Further, in U.S. Pat. No. 3,350,344, granted to Beers, the properties of organosilicone putties in general are described as being resilient and deformable.

The compositions of the above noted prior art polysiloxane-boron compounds have not resulted in materials which have significant stretch elasticity or stretch recovery property. These elasticity properties are indicated by the ability of a putty material to return to its original form after having been stretched, molded or shaped. Thus, the above prior art materials did not provide a class of materials for physical therapy use displaying both bounce elasticity (compression stress recovery) and stretch elasticity (stretch stress recovery). Both of these desirable elasticity characteristics for therapeutic exercise putties were provided via the invention disclosed in U.S. Pat. No. 5,319,021 granted to the present inventor.

It has been long established that heat is an important therapeutic modality in upper extremity rehabilitation, particularly therapy applied to a patients hands and other upper body parts and muscles. In hand therapy, the most recognized effects of therapeutic heat are increased collagen tissue extensibility and decreased joint stiffness. Heat, at appropriate temperature levels, also provides pain relief, reduces muscle spasms, assists in the resolution of inflaminatory infiltrates, and increases blood flow. Temperatures greater than 60 degrees C. are destructive to collagen and actually cause the fibers to shrink and melt.

In physical therapy practice there are three ways in which heat is transferred to tissue, namely, conduction, convection and conversion. "Conduction" transfer of heat is accomplished by direct contact between two objects such as a patients hands with hot packs or in paraffin baths. "Convection" transfer of heat involves heat exchange between a surface and a moving heat medium such as may be accomplished by body part immersion in a whirlpool bath or by fluidotherapy. "Conversion" transfer of heat concerns the penetration of non-thermal energy, such as ultrasound, into deeper tissue areas and the conversion thereat into heat energy. Paraffin baths comprise a principal means of heat therapy with the temperatures of such baths ranging from about 47.0 degrees C. (116 degrees F.) to about 54.4 degrees C. (130 degrees F.).

In U.S. Pat. No. 5,472,994 the inventors, A. M. Micallef and R. M. Gibbon, have disclosed and claimed a microwaveable exercise putty whereby physical therapy applications are provided with the therapeutic benefits of both physical exercise and conduction heat. While the Micallef et al patent sets forth specific preferred exercise putty compositions comprised of mixtures of: a chain-extended polysiloxane reaction product; an unreacted, uncured second polysiloxane compound; an internal lubricant; and a particulate material susceptible of heating when subjected to microwave energy, there is no teaching or suggestion in the patent of an appropriate and safe temperature range for the microwave heating of the compositions and the application of the putty for use as a heated therapeutic exercise medium. Further, there is no indication as to how a physical therapist determines that the microwave heated exercise putty is suitable and safe for use in an exercise therapy regimen.

It is a principal object of the present invention to provide an exercise putty composition of the general and improved type disclosed in U.S. Pat. No. 5,319,021 (exercise putties that display both bounce elasticity and stretch elasticity) as an exercise putty mass in a microwaveable container which includes indicia means to indicate to a physical therapist and/or a therapy patient a satisfactory and safe temperature of the putty mass.

It is a further object of the invention to provide a microwave-heatable exercise putty mass in a transparent microwaveable container within which there is positioned a viewable temperature indicia means, in heat transfer proximity to the putty mass, to indicate to a physical therapist and/or a therapy patient, after microwave heating of the container and putty mass, that the putty mass has been heated to a satisfactory and safe temperature for use as a heated exercise therapy medium.

It is a still further object of the invention to provide a microwave-heatable therapeutic exercise putty mass in a transparent microwaveable container within which there is positioned a viewable indicia means, in heat transfer proximity to the putty mass, for indication to a physical therapist and/or therapy patient, after microwave heating of the container and putty mass, that the putty mass has been heated to an acceptable temperature ("OK" to use indication) for therapy use or has been heated to a non-acceptable temperature ("TOO HOT" to use indication) state and must not be used for human physical therapy.

Other objects and advantages of the present invention will be apparent from the following summary and detailed descriptions of the invention, taken together with the accompanying drawing figures.

SUMMARY OF THE INVENTION

The present invention relates to the microwave heating of exercise putty compositions to provide a satisfactory and safe heated putty mass for use as a heated therapeutic exercise medium. In accordance with the invention, a mass of a deformable solid putty composition of the organopolysiloxane-boron type, which exhibits both bounce elasticity and stretch elasticity, is placed in a transparent plastic container having a cup-like base portion and a removable top portion. Affixed to the inside of the bottom wall of the base portion of the container is a heat sensitive strip, label, membrane or coating which includes a thermochromic semiconductor material which varies in transparency and color in response to various temperature levels to which the material is exposed.

The thermochromic heat sensitive material temperature indicator strip (or label, membrane, coating, etc.) within the container is in contact with the microwaveable exercise putty composition. In accordance with the present invention, the indicator displays a first indication showing that the putty composition has reached (by microwave energization) a heated temperature of about 40 to about 47 degrees C., a temperature range which provides a most suitable therapeutic heat value. When there is further microwave heating of the putty composition within the container, the indicator displays a second indication showing that the putty composition has reached a heated temperature of about 54 to about 60 degrees C. and warning that the composition is to hot for use as a heated therapeutic exercise putty.

The optical appropriate temperature indication and the optical dangerous temperature indication provided by the thermochromic temperature indicator material may, for example, be in the form of color changes of the indicator material, by display of heat approval words such as "OK" or heat disapproval words such as "TOO HOT", or by display of perferred temperature indicating numerals such as 47° C. or 54° C.

BRIEF DESCRIPTION OF THE DRAWING FIGURES

The present invention, as described in greater detail hereinafter, relates to a non-limitative embodiment and with reference to the attached drawing figures wherein.

Figure 1:
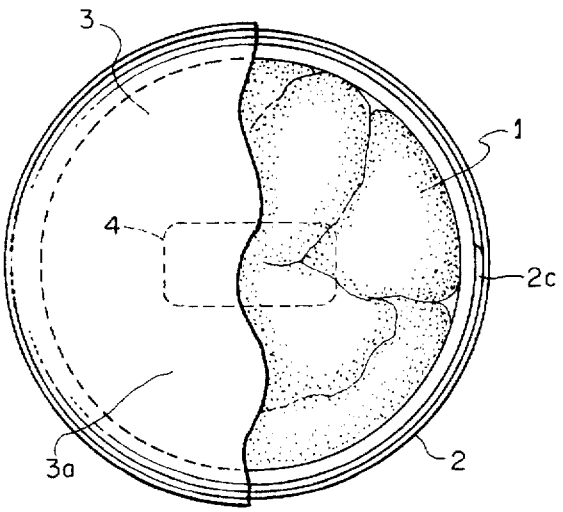
FIG. 1 is a top view of a transparent container having a cup-like base portion and a removable top portion for holding microwave-heatable exercise putty with the container top portion partially cut away to show the enclosed mass of exercise putty according to the present invention.
Figure 2:
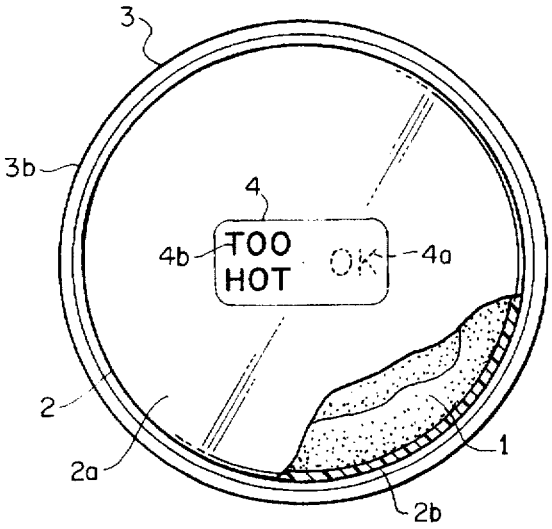
FIG. 2 is a bottom view of the transparent putty container of FIG. 1 showing a heat sensitive strip located within the container in contact with the exercise putty for visual indication, through the transparent base portion, of the acceptable (OK) or non-acceptable (TOO HOT) state of the enclosed putty after exposing the container and putty to microwave heating.
Figure 3:
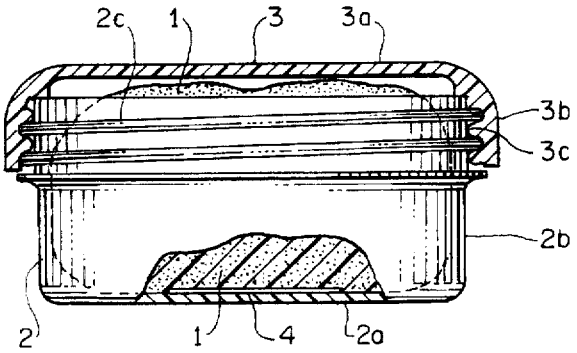
Figure 4:
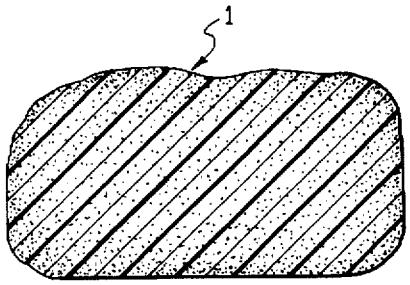

FIG. 3 is a side view of the putty container of FIGS. 1 and 2 with the removable top portion of the container shown in section and with the cup-like base portion of the container partially cut away to show in section the enclosed mass of putty and heat sensitive strip located proximate the bottom wall of the container in contact with the mass of putty; and FIG. 4 is a schematic sectional view of a mass of exercise putty according to the present invention.

DETAILED DESCRIPTION OF THE INVENTION

Microwave-heatable exercise putties according to the present invention include organopolysiloxane-boron deformable compositions which exhibit both bounce elasticity and stretch elasticity and comprise a bouncing putty type polysiloxane-boron compound including elastic particles, filler material, softener material, lubricants, fumed silica and starch. The putties may include one or more colorants. A mass of such a deformable solid putty composition is placed in a transparent plastic microwaveable container having a cup-like base portion and a removable top portion, such container comprising a storage unit and marketing package for the putty composition. Preferably, the mass of putty is in a total amount of about 80 to 100 cc which is the approximate amount of a hand-full of putty reasonably gripable by the average adult human hand and such volume of putty dictates the approximate volume of the microwaveable packaging container. Affixed to the inside of the bottom wall of the base portion of the container is a heat sensitive strip, label, membrane or coating (hereinafter referred to, without limitation, as a heat sensitive strip) which includes a thermochromic semiconductor material which varies in transparency and color in response to various predetermined temperature levels to which the material is exposed.

The thermochromic heat sensitive temperature indicator strip within the microwaveable container is in contact with contained exercise putty composition. In accordance with the present invention, the thermochromic indicator strip is prepared in known fashion whereby it displays a first indication (color, numerical temperature figure, or acceptance word, etc.) showing that the putty composition within the container has reached (by microwave energization) a desired heated temperature of about 47° C., a temperature which provides a most suitable therapeutic heat value. When there is a further microwave heating of the putty composition, the indicator strip is prepared to display a second indication (color, numerical temperature figure, or warning word, etc.) showing that the putty composition has reached a heated temperature of about 54° C. or higher and warning that the composition is to hot for use as a heated therapeutic exercise putty.

A preferred microwaveable plastic container, with an enclosed mass of exercise putty, is shown in FIGS. 1, 2 and 3 of the drawing sheet. FIG. 1 is a top view of a transparent container for holding a mass of microwave-heatable exercise putty 1 in accordance with the invention. A cup-like base portion 2 of the container (see particularly FIG. 3) is closed by a removable top portion (container cover) 3. The removable container cover 3 has been partially cut away in the figure to show the enclosed mass of exercise putty 1 which substantially fills the container. Shown in dashed outline is the thermochromic temperature indicator strip 4 which is affixed to the bottom wall 2*a* of the base portion (see FIGS. 2 and 3 which further show the structure of the container and the preferred position of the indicator strip).

FIG. 2 is a bottom view of the transparent exercise putty container of FIG. 1 showing the thermochromic heat sensitive indicator strip 4 as located within the container in contact with the exercise putty enclosed therein for visual temperature value or condition indication, through the transparent bottom wall 2*a* of the cup-like base portion 2 of the container. A portion of the bottom wall 2*a* is cut away to show the enclosed mass of putty 1 FIG. 3 is a side view of the putty container of FIGS. 1 and 2 with the removable top portion (cover) 3 shown in section and with the cup-like base portion 2 of the container partially cut away to show in section the enclosed mass of exercise putty 1. As clearly illustrated in FIG. 3, the base portion 2 of the microwaveable container includes bottom wall 2*a* and annular side wall 2*b* with the upper edge of the side wall 2b including external threads 2c. The container cover 3 includes a top wall 3a with a depending annular skirt portion 3b including internal threads 3c which mate with the threads 2c of the base portion of the container for removable threaded engagement of the cover 3 with the base 2 and substantial sealing of the container with its enclosed mass of exercise putty 1. In FIG. 3 the thermochromic is temperature indicator strip 4 is shown affixed to the transparent bottom wall 2a of the container base portion 2 in close heat transfer proximity with the putty mass 1.

As shown in FIG. 2 the thermochromic heat sensitive temperature indicator strip 4 is visible through the transparent bottom wall 2a of the cup-like base portion 2 of the microwaveable container. As illustrated in the figure, the indicator strip 4 is in heat transfer contact with the exercise putty 1 enclosed within the container. The indicator strip 4 highlights in bold letters 4b that the putty mass has been overheated (over the temperature of about 54° C. to about 60° C.) and that the putty is "TOO HOT" for use in exercise physical therapy. Shown in dashed outline 4a are the letters "OK" which will appear on the strip when the putty mass has dropped in temperature to below about 54° C. so long as the putty mass does not drop in temperature to below about 40° C. to about 47° C. So-long-as the temperature indicator strip 4 displays the letters "OK" the putty material is in a heated condition which is preferred and most suitable for use in heated exercise physical therapy. If the temperature of the putty mass is at a temperature below about 40° C. the indicator strip 4 will display no temperature indicator letters, words, indicator colors, or numerals and may itself be transparent or display a neutral or other color not representative of the acceptable or not acceptable temperature condition of the putty mass within the container in heat transfer contact with the strip.

In FIG. 4 a heated microwave-heated exercise putty mass 1 (mass volume of from about 80 to about 100 cc) is shown as removed from a microwave oven and the microwaveable container within which it has been held during the microwave heating of the putty. A microwave oven of common household kitchen design (power ratings in the range of 800 to 1200 watts) may be utilized to heat the exercise putty and its container. Microwave heating times in the range of 25 seconds to 50 seconds will usually be satisfactory for heating the putty to within the appropriate temperature range of about 40° C. and about 60° C. for heat therapy where the putty mass has a volume in the 80–100 cc range. Several heating test runs should be made to obtain a time value for each putty mass before using the putty for heated exercise therapy.

Although the present invention has been fully described with reference to the accompanying drawing figures, various additions, changes and modifications will be apparent to those having skill in the exercise putty field. Therefore, unless otherwise these changes and modifications depart from the scope of the present invention as set forth in the appended claims, they should be construed as included therein.

What is claimed is:

1. A microwave-heatable therapeutic exercise putty mass packaged in a microwaveable container having at least one transparent wall, said putty mass being in heat transfer proximity with said transparent container wall, and thermochromic heat sensitive semiconductor material affixed to said transparent wall within said container and in intimate heat transfer contact with said putty mass, said thermochromic material providing a visual first indication through said transparent wall when said putty mass has been microwave heated to a therapy acceptable temperature range of about 40 to about 47 degrees C. and a visual second indication through said transparent wall when said putty mass has been microwave heated to a temperature range of about 54 to about 60 degrees C. or above which is non-acceptable for heat therapy.

2. A microwave-heatable therapeutic exercise putty mass packaged in a microwaveable container as claimed in claim 1 wherein said thermochromic material provides a visual first indication when said putty mass has been microwave heated to a temperature of about 47 degrees C. and a second visual indication when said putty mass has been microwave heated to a temperature of about 54 degrees C.

3. A microwave-heatable therapeutic exercise putty mass packaged in a microwaveable container as claimed in claim 1 wherein the thermochromic heat sensitive semiconductor material affixed to said transparent wall within said container is in a form selected from the group including: strip forms; label forms; membrane forms and coatings.

4. A microwave-heatable therapeutic exercise putty mass packaged in a microwaveable container as claimed in claim 1 wherein the microwaveable container is a transparent plastic container having a cup-like base portion and a removable top portion and said thermochromic heat sensitive material is affixed to the inner surface of the bottom wall of said base portion of said container and said thermochromic material is visible through said bottom wall.

5. A method for microwave-heating a therapeutic exercise putty to an acceptable therapeutic temperature in the range of about 40 degrees C. to about 60 degrees C. comprising:

a) packaging a mass of therapeutic exercise putty in a microwaveable container having at least one transparent wall, said putty mass being in heat transfer proximity with said transparent wall;

b) affixing thermochromic heat sensitive semiconductor material to said transparent wall within said container and in intimate heat transfer contact with said putty mass, said thermochromic material yielding a visual first indication when the temperature of said material reaches about 40 to about 47 degrees C. and yielding a visual second indication when the temperature of said material reaches about 54 to about 60 degrees C.;

c) heating said container and said contained putty mass in a microwave oven for a period of time and under microwave power conditions estimated to heat said container and putty mass to a temperature of at least about 40 to about 47 degrees C.; and d) inspecting the transparent wall of said container to determine whether said contained putty mass has been heated to a therapy acceptable temperature of at least about 40 to about 47 degrees C. as established by said visual first indication of said thermochromic material and not more than a non-acceptable therapy temperature of over about 54 to about 60 degrees C. as established by said visual second indication of said thermochromic material.

6. The method for microwave-heating a therapeutic exercise putty to an acceptable therapeutic temperature as claimed in claim 5 wherein said thermochromic material provides a visual first indication when said putty mass has been microwave heated to a temperature of about 47 degrees C. and a second visual indication when said putty mass has been microwave heated to a temperature of about 54 degrees C.

7. The method for microwave-heating a therapeutic exercise putty to an acceptable therapeutic temperature as claimed in claim 5 wherein said therapeutic exercise putty is packaged in a microwaveable container having a transparent cup-like base portion and a removable top portion and said thermochromic heat sensitive material is affixed to the inner surface of the bottom wall of said base portion of said container and said thermochromic material is visible through said bottom wall.

8. The method for microwave-heating a therapeutic exercise putty to an acceptable therapeutic temperature as claimed in claim 5 wherein said thermochromic heat sensitive material is in a form selected from the group including: strip forms; label forms; membrane forms; and coatings.

9. The method for microwave-heating a therapeutic exercise putty to an acceptable therapeutic temperature as claimed in claim 5 wherein said thermochromic material provides a visual first indication in the form of a color, numerical temperature indication or word indication of acceptability when the temperature of said material reaches about 47 degrees C. and said thermochromic material provides a visual second indication in the form of a color, numerical temperature indication or word indication of non-acceptability when the temperature of said material reaches 54 degrees C.

* * * * *